United States Patent [19]

Fujino et al.

[11] Patent Number: 4,754,121

[45] Date of Patent: Jun. 28, 1988

[54] COOKING APPLIANCE WITH A SELECTIVELY DETACHABLE DOOR

[75] Inventors: Shiunji Fujino, Osaka; Itiro Oshima, Nara; Akinori Kitajima, Yao, all of Japan

[73] Assignee: Sharp Kabushiki Kaisha, Osaka, Japan

[21] Appl. No.: 884,599

[22] Filed: Jul. 11, 1986

[30] Foreign Application Priority Data

Jul. 12, 1985 [JP] Japan ..... 60-107206[U]

[51] Int. Cl.[4] ..... F24C 15/04; E05D 7/02; E05C 19/16

[52] U.S. Cl. ..... 219/386; 126/190; 49/382

[58] Field of Search ..... 219/385, 386; 126/190, 126/194; 49/382, 394

[56] References Cited

U.S. PATENT DOCUMENTS

| | | | |
|---|---|---|---|
| 3,396,490 | 8/1968 | Dukas | 49/382 |
| 3,430,386 | 3/1969 | Sandin | 49/382 |
| 3,455,061 | 7/1969 | Kesling | 49/382 |
| 4,258,632 | 3/1981 | LaPointe | 49/382 |

FOREIGN PATENT DOCUMENTS

| | | | |
|---|---|---|---|
| 933951 | 10/1955 | Fed. Rep. of Germany | 126/194 |
| 3111595 | 10/1982 | Fed. Rep. of Germany | 49/382 |
| 301255 | 9/1965 | Netherlands | 126/194 |

*Primary Examiner*—E. A. Goldberg
*Assistant Examiner*—Teresa J. Walberg
*Attorney, Agent, or Firm*—Birch, Stewart, Kolasch & Birch

[57] ABSTRACT

A heating appliance including a heating chamber, a selectively detachable door for opening and closing the opening of the heating chamber, a pair of support members pivotably supporting the selectively detachable door for allowing the selectively detachable door to be positioned so that it opens in a first predetermined direction or positioned so that it opens in a second predetermined direction. The selectively detachable door is detachably engaged with the heating appliance by the first and second engaging members.

7 Claims, 3 Drawing Sheets

COOKING APPLIANCE WITH A SELECTIVELY DETACHABLE DOOR

BACKGROUND OF THE INVENTION

The present invention relates to a cooking or heating appliance such as an electric heater or toaster oven and, more particularly, to a cooking or heating appliance including a selectively detachable door for detachably selecting the door opening direction by a user.

A heating appliance such as a toaster oven many times installed at a relatively space-limited portion in a kitchen. For example, the oven toaster is installed on an electric refrigerator or a table, or is suspended under a shelf. Various types installments of the cooking appliance are possible. Since the door of the conventional cooking appliance is opened and closed in a fixed direction, it is not suitable for certain installments in the limited kitchen space. Thus, it is desired that the door structure of the cooking appliance enables suitable opening/closing operation when the appliance is installed at any space-limited portion in a kitchen.

SUMMARY OF THE INVENTION

Accordingly, it is an object of the present invention to provide a cooking or heating appliance in which the door opening direction can be freely selected.

It is another object of the present invention to provide a cooking or heating appliance including a selectively detachable door in which the pivotable axis receiving the detachable door can be selected among two or more axes.

It is still another object of the present invention to provide a door structure of a cooking appliance in which the opening direction of the door can be selected by the user according to the location that the appliance will be installed.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To achieve the above objects, according to an embodiment of the present invention, a heating appliance comprises a heating chamber, a selectively detachable door for opening and closing the opening of the heating chamber, first engaging means for opening the selectively detachable door in a first predetermined direction, and second engaging means for opening the selectively detachable door in a second predetermined direction. The selectively detachable door is detachably engaged with the heating appliance by either one of the first and the second engaging means.

To achieve the above objects, according to another embodiment of the present ivnention, a heating appliance comprises first and second wall members forming an opening of a heating chamber, the first wall member being opposite to the second wall member, a selectively detachable door for opening and closing the opening of the heating chamber, the door including a first engaging member and a second engaging member, a pair of first and second supporting members for detachably and pivotably supporting the door to open the door in a first predetermined direction, the first supporting member being provided on the first wall member for engaging with the first engaging member, the second supporting member being provided on the second wall member for engaging with the second engaging member, and a pair of third and forth supporting members for detachably and pivotably supporting the door to open the door in a second predetermined direction, the third supporting member being provided on the first wall member for engaging with the first engaging member, the forth supporting member being provided on the second wall member for engaging with the second engaging member.

The user may select either one of the pairs of supporting members to select the door opening direction from in the first predetermined direction and or the second predetermined direction.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE PREFERRED EBODIMENTS

A cooking or heating appliance according to an embodiment of the present invention will be described with reference to FIGS. 1 through 9. Although the present invention is applied to a toaster oven, the present invention should not be limited to the toaster oven and may be applied to various cooking or heating appliances.

Figure 1:
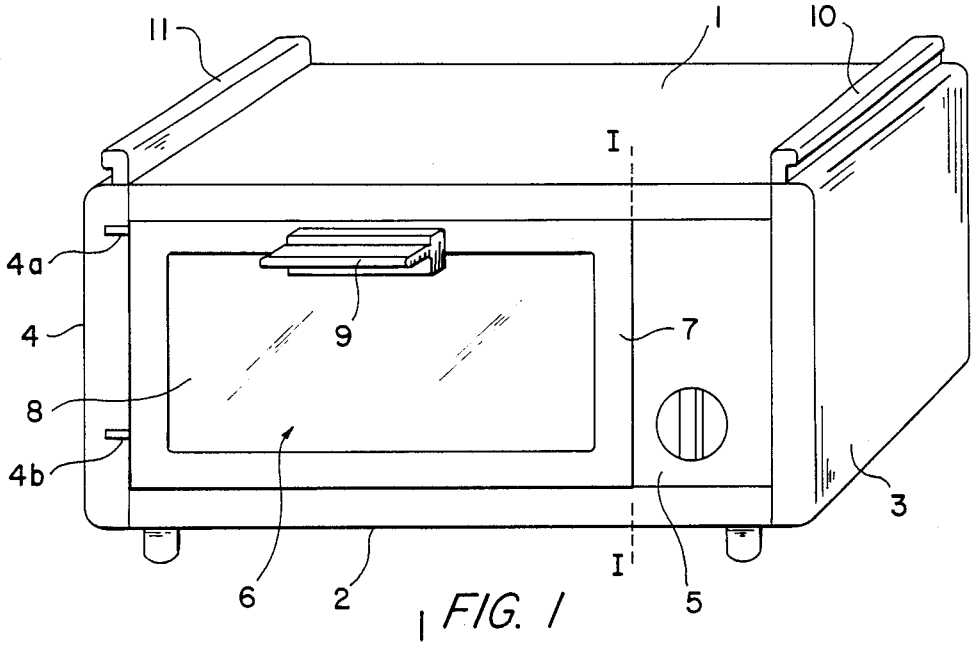
FIG. 1 shows a perspective view of a heating appliance including a selectively detachable door according to an embodiment of the present invention.

As shown in FIG. 1, a cooking or heating appliance such as a toaster oven comprises an upper wall panel 1, a bottom wall panel 2, right and left side wall panels 3 and 4, a front wall panel 5, and a selectively detachable door 6 for opening and closing the opening formed at the front of the cooking appliance. The panels 1, 2, 3, 4, and 5 form a box-like cooking appliance main body or a heating chamber. The detachable door 6 comprises a door frame 7 made of metallic material glass window 8 for viewing an object in the heating chamber, and a pull 9 for pulling or pushing when opening and closing the door 6, etc. The detachable door 6 is detachably and pivotably engaged with the cooking or heating appliance to open the detachable door 6 in a first direction or a second direction. Reversed "L" projections 10 and 11 are provided on the upper portions of the right and the left side wall panels 3 and 4, respectively, for hanging the cooking appliance when the user wants to hang the cooking appliance under a shelf. The cooking appliance, further, includes heating means such as a heater for heating the object disposed in the heating chamber and a control circuit for controlling the operations of the heating means. A control unit having a heating start switch and a timer is provided on the front wall panel 5 for selecting the condition of the cooking.

Figure 2:
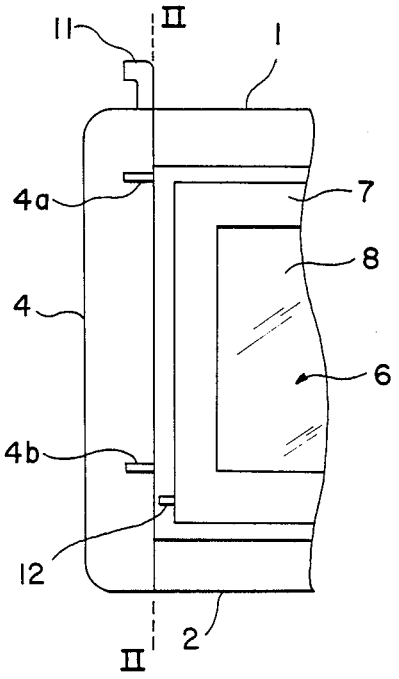
FIG. 2 shows a partial front view of the heating appliance according to an embodiment of the present invention.
Figure 3:
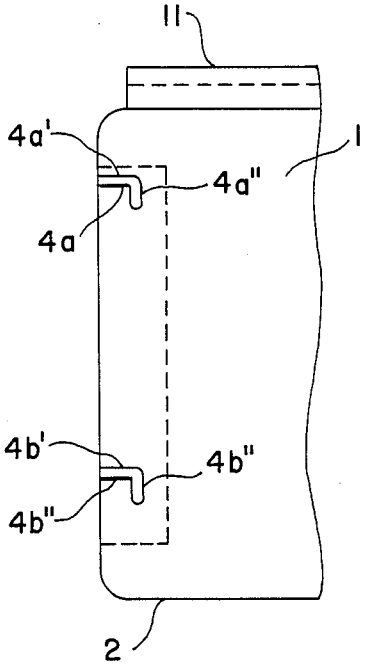
FIG. 3 shows a sectional view of the heating appliance taken along a line II—II of FIG. 2.
Figure 4:
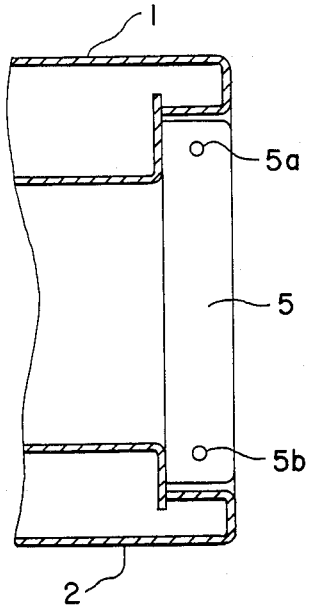
FIG. 4 shows a sectional view of the heating appliance taken along a line I—I of FIG. 1.

As shown in FIGS. 2 and 3, "L" shaped engaging grooves 4*a* and 4*b* are provided at the upper portion and the lower portion, respectively, of the left side wall panel 4 on the side of the heating chamber as first door supporting means. Each of the engaging grooves 4*a* and 4*b* comprises a horizontal groove (4*a*′ or 4*b*′) extending from the front of the left side wall panel 4 to the back portion of the left side wall panel 4, and a vertical groove (4*a*″ or 4*b*″) extending a short distance from one end of the horizontal groove (4*a*′ or 4*b*′) to the lower portion of the left side wall panel 4. As shown in FIG. 4, shaft insertion holes 5*a* and 5*b* are provided at the upper portion and the lower portion, respectively, of the front wall panel 5, opposite to the "L" shaped eangaing grooves 4*a* and 4*b* of the left side wall panel 4, as second door supporting means. In the embodiment of the present invention, pairs of first and second door supporting means are provided. For example, a first pair comprises the engaging grooves 4*a* and the shaft insertion hole 5*a*, and a second pair comprises the engaging groove 4*b* and the shaft insertion hole 5*b*. Projections shafts 12 and 12′ are provided on the side walls of the opposite portion of the frame 7, respectively of the door 6 on which the pull 9 is disposed. The projection shafts 12 and 12′ are projected through the elongated holes 7*a* and 7*a*′ provided on the frame 7 so that the projection shafts 12 and 12′ can move in the elongated holes 7*a* and 7*a*′, respectively, through the maximum length of the holes. The projection shafts 12 and 12′ are usually positioned at the end of the elongated holes 4*a* and 4*b*, respectively, due to biasing in one direction by springs. The height of the lower end of each of the vertical grooves 4*a*″ and 4*b*″ is equal to the height of each of the shaft insertion holes 5*a* and 5*b* provided on the front wall panel 5. The door 6 is substantially in contact with the wall panels 1, 2, 4 and 5 when the door 6 is closed. When the door 6 is attached to the cooking appliance, the projection shafts 12 and 12′ of the door 6 are inserted into either one of the pairs of first and second supporting means. For example, when in an upper-opening mode, the projection shafts 12 and 12′ of the door 6 are inserted into the engaging groove 4*a* and the shaft insertion hole 5*a* so that the door 6 pivots about the line formed by the projection shafts 12 and 12′. When in a lower-opening mode, the projection shafts 12 and 12′ are inserted into the engaging groove 4*b* and the shaft insertion hole 5*b* so that the door 6 pivots around the line formed by the projection shafts 12 and 12′.

A magnet 13 is provided on a step portion of the front of the upper wall panel 1 so that the inner surface of the frame 7 of the door 6 made of metallic material is attracted to the magnet 13.

LOWER-OPENING MODE

Figure 5:
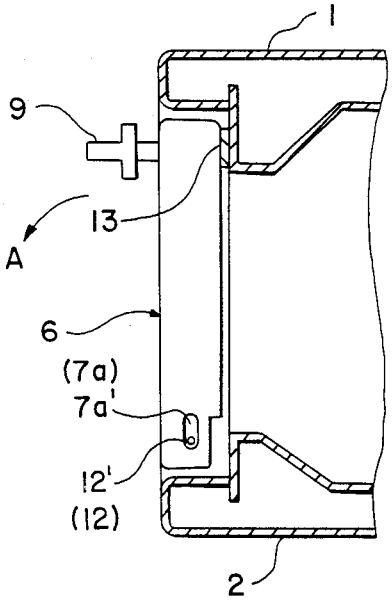
FIG. 5 shows a sectional view of the heating appliance when the door 6 is closed by the lower-opening structure.
Figure 6:
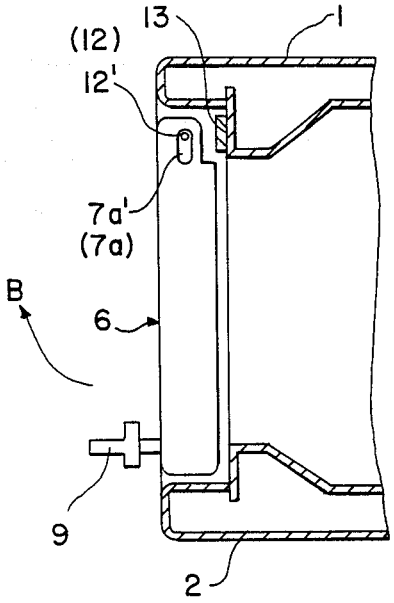
FIG. 6 shows a sectional view of the heating appliance when the door 6 is closed by the upper-opening structure.

In this operating mode, the door 6 is opened by pulling in the lower direction A against the main body of the appliance. The projection shaft 12′ projects from the side wall of the door 6 is inserted into the shaft insertion hole 5*b* provided on the front wall panel 5, and the projection shaft 12 is inserted into the "L" eangaging groove 4*b* disposed at the lower portion of the left side wall panel 4 by inserting along the horizontal groove 4*b* and the vertical groove 4*b*″. After projection shafts 12 and 12′ are inserted into the shaft insertion hole 5*b* and the engaging groove 4*b*, the projection shaft 12 is positioned at the lower end of the vertical groove 4*b*″. In this mode, the door 6 is pivotably mounted about the line formed by the shaft insertion hole 5*b* and the lower end of the vertical groove 4*b*″, namely, by the projection shafts 12 and 12′, so that the door 6 can be opened by pulling in the lower direction A. As shown in FIG. 5, when the door 6 is closed, the upper portion (the frame 7) of the door 6 is attracted to the magnet 13 provided on the step portion of the upper wall panel 1 to securely close the door 6. The door 6 is not released from the cooking appliance during the door opening/-closing operations because one of the projection shafts 12 and 12′ of the door 6 is inserted into one of the "L" shaped grooves 4*a* and 4*b*.

When the door 6 is released from the cooking appliance because the door structure is changed from the lower opening mode to the upper opening mode, the projection shaft 12 is pulled out through the vertical groove 4*b*″ and the horizontal groove 4*b*′, and thereafter, the projection shaft 12′ is pulled out from the shaft insertion hole 5*b*.

UPPER-OPENING MODE

Figure 7:
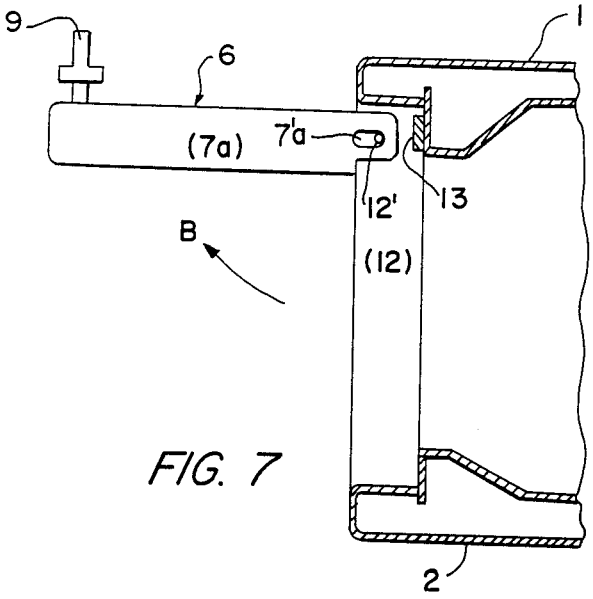
FIG. 7 shows a sectional view of the heating appliance of FIG. 6 when the door 6 is opened in the upper direction B.
Figure 8:
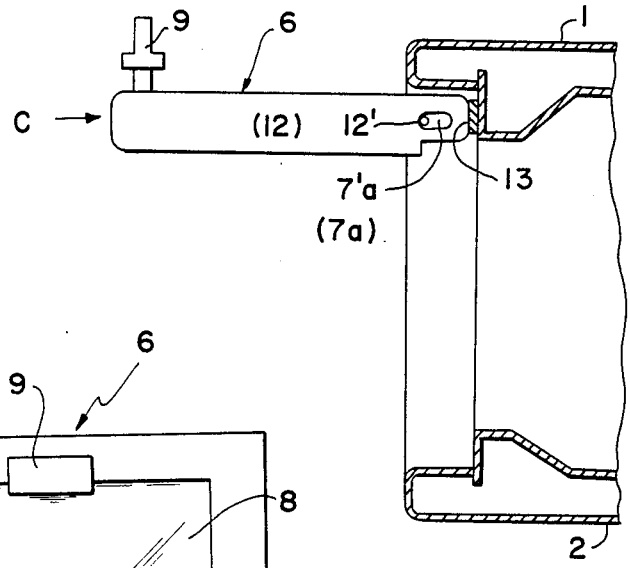
FIG. 8 shows a sectional view of the heating appliance of FIG. 7 when the door 6 is pushed in the horizontal direction C.
Figure 9:
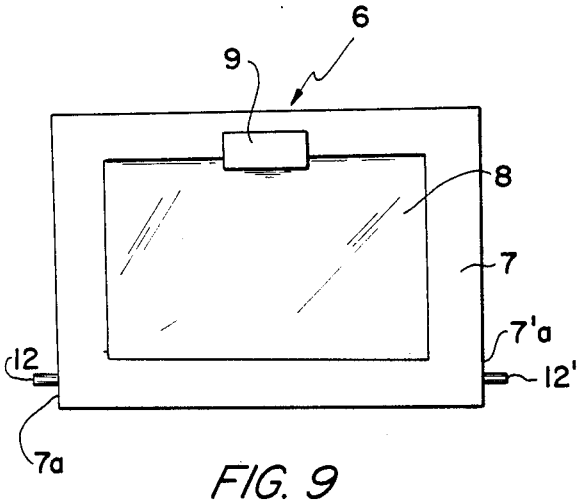

In this operating mode, the door 6 is opened by pulling in the upper direction B against the main body of the appliance. The projection shaft 12′ is inserted into the shaft insertion hole 5*a*, and the projection shaft 12 is inserted into the "L" shaped engaging groove 4*a* by inserting the projection shaft 12 along the horizontal groove 4*a*′ then along the vertical groove 4*a*″. When the insertion of the projection shafts 12 and 12′ into the shaft insertion hole 5*a* and the engaging groove 4*a* is completed, the projection shaft 12 is positioned at the lower end of the vertical groove 4*a*″. In this mode, the door 6 is pivotably mounted about the line formed by the shaft insertion hole 5*a* and the lower end of the vertical groove 4*a*″, namely, the projection shafts 12 and 12′, so that the door 6 can be opened by pulling up in the upper direction B. When the door 6 is closed, the pull 9 provided at the lower portion of the center of the door 6 is pulled up in the upper direction B to open the door 6 so that the door 6 is rotated by about 90 degrees about the line formed by the projection shafts 12 and 12′, and the door 6 is positioned in substantially the horizontal direction as shown in FIG. 7. When the door 6 is horizontally positioned and is pushed in the direction C of the cooking appliance, the end of the door 6 is attracted to the magnet 13 as shown in FIG. 8 since the projection shafts 12 and 12′ can move in the elongated holes 7*a* and 7*a*′, respectively. Therefore, the door 6 is held opened in the horizontal direction.

As described above, two pair of first and second door supporting means are provided on the upper and lower portions of two wall panels forming the opening of the heating chamber which is securely closed by the door.

One of the pair of fisrt and second door supporting means is opposite to the other one of the pair of first and second door supporting means. The engaging means are provided on the side walls opposite the portion of the door on which the pull is disposed. The engaging means are provided for engaging with one pair of first and second door supporting means to select the door opening direction or the door closing direction. Because the engaging means are engaged with either pair of the door supporting means, the door opening direction or the door closing direction is freely selected.

If the cooking appliance is installed at a high position, the door may be opened in the upper-opening mode. If the cooking appliance is installed at a lower position, the door may be opened in the lower-opening mode. In the present invention, the user can select either the upper-opening mode or the lower-opening mode.

Although, in the embodiment of the present invention, the upper opening mode and the lower-opening mode are provided for vertically opening/closing of the door, a right-opening mode and a left-opening mode structure may be provided for horizontally opening/-closing the door. For example, the first supporting means may be provided at the upper wall panel, and the second supporting means may be provided at the bottom wall panel.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A heating appliance comprising:

a first wall member and a second wall member partially defining a heating chamber having an opening, said first wall member being disposed opposite said second wall member, said first wall member having a first L-shaped slot extending from an edge of said first wall member positioned at the opening of said heating chamber, said second wall member having a first hole positioned opposite said first L-shaped slot in said first wall member; and a detachable door positioned adjacent said opening of said heating chamber for opening and closing said heating chamber, said door having a first engaging means for cooperating with said first L-shaped slot and a second engaging means for cooperating with said first hole for removably and pivotably supporting said detachable door.

2. The appliance according to claim 1, wherein said first and second engaging means are shafts projecting from said detachable door.

3. The appliance according to claim 1, wherein said first and second engaging means are both located along a pivotal axis of said detachable door.

4. The appliance according to claim 1, wherein one of said first and second wall members is provided with a second L-shaped slot and the other wall member is provided with a second hole positioned opposite to said second L-shaped slot for allowing a user to attach said detachable door to either said first L-shaped slot and said first hole or to said second L-shaped slot and said second hole for selecting a door opening direction in a first predetermined direction or in a second predetermined direction.

5. The appliance according to claim 4, wherein said first and second engaging means are shafts projecting from said detachable door.

6. The appliance according to claim 4, wherein said first and second engaging means are both located along a pivotal axis of said detachable door.

7. The appliance according to claim 4, including a magnet attached to a third wall member partially defining said heating chamber and wherein said door is at least partially metallic, said magnet acting as a means for releasably locking said detachable door shut when positioned to open in said first predetermined direction and acting as a means for releasably locking said door open when said detachable door is positioned to open in said second predetermined direction.

* * * * *